US008480357B2

(12) United States Patent
Nikolic et al.

(10) Patent No.: US 8,480,357 B2
(45) Date of Patent: Jul. 9, 2013

(54) VARIABLE GEOMETRY TURBOCHARGER WITH GUIDE PINS

(75) Inventors: Kolja Nikolic, Yorba Linda, CA (US); Michael Moyer, Redondo Beach, CA (US); George Adeff, Westchester, CA (US); Kevin Slupski, Redondo Beach, CA (US); Matthew Oakes, Redondo Beach, CA (US); Dennis L. Brookshire, Novi, MI (US)

(73) Assignee: Honeywell International Inc., Morristown, NJ (US)

( * ) Notice: Subject to any disclaimer, the term of this patent is extended or adjusted under 35 U.S.C. 154(b) by 912 days.

(21) Appl. No.: 12/614,618

(22) Filed: Nov. 9, 2009

(65) Prior Publication Data

US 2011/0110768 A1 May 12, 2011

(51) Int. Cl.
*F01D 17/16* (2006.01)
*F02B 37/22* (2006.01)

(52) U.S. Cl.
USPC ..... 415/160; 415/164; 415/165

(58) Field of Classification Search
USPC ..... 415/159, 160, 161, 164, 165, 166
See application file for complete search history.

(56) References Cited

U.S. PATENT DOCUMENTS

| | | | | |
|---|---|---|---|---|
| 6,419,464 | B1 | 7/2002 | Arnold | |
| 6,925,806 | B1 * | 8/2005 | Zollinger et al. | 60/602 |
| 7,396,204 | B2 * | 7/2008 | Shiraishi et al. | 415/160 |
| 2008/0240906 | A1 | 10/2008 | Barthelet et al. | |
| 2009/0252601 | A1 | 10/2009 | Wengert et al. | |

FOREIGN PATENT DOCUMENTS

| | | |
|---|---|---|
| DE | 102004023209 | * 12/2005 |
| DE | 102004023211 | * 12/2005 |
| DE | 102008000508 | 10/2009 |
| EP | 2103793 | 3/2009 |
| WO | 2008/095568 | 8/2008 |
| WO | 2009/092678 | 7/2009 |

* cited by examiner

*Primary Examiner* — Edward Look
*Assistant Examiner* — Jesse Prager
(74) *Attorney, Agent, or Firm* — Alston & Bird LLP

(57) ABSTRACT

A variable geometry turbocharger assembly comprises a unison ring which rotates about a longitudinal axis defined by a shaft on which a turbine wheel and compressor wheel are attached in order to pivot a plurality of vanes and thereby control a flow of exhaust gas to the turbine wheel. The unison ring rotates on at least one guide pin which is secured to the turbocharger. The guide pins may be press-fit into apertures in a center housing at an outer pilot surface. In other embodiments the guide pins may be press-fit into a different part of the turbocharger such as a nozzle ring. The guide pins may each have a wear surface which defines a circumferential radius of curvature which is substantially equal to a circumferential radius of curvature of a radially inner surface of the unison ring.

16 Claims, 4 Drawing Sheets

VARIABLE GEOMETRY TURBOCHARGER WITH GUIDE PINS

BACKGROUND OF THE INVENTION

1. Field of the Invention

The present invention relates generally to turbochargers. More specifically, the present invention relates to variable geometry turbocharger assemblies.

2. Description of Related Art

An exhaust gas-driven turbocharger is a device used in conjunction with an internal combustion engine for increasing the power output of the engine by compressing the air that is delivered to the air intake of the engine to be mixed with fuel and burned in the engine. A turbocharger comprises a compressor wheel mounted on one end of a shaft in a compressor housing and a turbine wheel mounted on the other end of the shaft in a turbine housing. Typically the turbine housing is formed separately from the compressor housing, and there is yet another center housing connected between the turbine and compressor housings for containing bearings for the shaft. The turbine housing defines a generally annular chamber that surrounds the turbine wheel and that receives exhaust gas from an engine. The turbine assembly includes a nozzle that leads from the chamber into the turbine wheel. The exhaust gas flows from the chamber through the nozzle to the turbine wheel and the turbine wheel is driven by the exhaust gas. The turbine thus extracts power from the exhaust gas and drives the compressor. The compressor receives ambient air through an inlet of the compressor housing and the air is compressed by the compressor wheel and is then discharged from the housing to the engine air intake.

One of the challenges in boosting engine performance with a turbocharger is achieving a desired amount of engine power output throughout the entire operating range of the engine. It has been found that this objective is often not readily attainable with a fixed-geometry turbocharger, and hence variable-geometry turbochargers have been developed with the objective of providing a greater degree of control over the amount of boost provided by the turbocharger. One type of variable-geometry turbocharger is the variable-nozzle turbocharger, which includes an array of variable vanes in the turbine nozzle. The vanes are pivotally mounted in the nozzle and are connected to a mechanism that enables the setting angles of the vanes to be varied. Changing the setting angles of the vanes has the effect of changing the effective flow area in the turbine nozzle, and thus the flow of exhaust gas to the turbine wheel can be regulated by controlling the vane positions. In this manner, the power output of the turbine can be regulated, which allows engine power output to be controlled to a greater extent than is generally possible with a fixed-geometry turbocharger.

The variable vane mechanism can be prone to performance and reliability issues. It is, therefore, desirable that a vane pivoting mechanism be constructed, for use with a variable nozzle turbocharger, in a manner that provides improved vane operational performance and reliability.

SUMMARY OF VARIOUS EMBODIMENTS

The present disclosure in one aspect describes a variable geometry turbocharger assembly having a turbine housing defining an inlet for exhaust gas and an outlet, with a turbine wheel located within the turbine housing and attached to a shaft. A nozzle defines a nozzle passage for exhaust flow to the turbine wheel, and a plurality of vanes is disposed within the nozzle passage. The vanes are pivotally mounted by way of bearing pins, each vane being arranged to pivot about an axis defined by its respective bearing pin. A center housing is connected to the turbine housing and comprises an outer pilot surface defining an outer radius. At least one guide pin is secured to the center housing adjacent the outer pilot surface, each guide pin defining a wear surface that extends to a radius larger than the outer radius of the outer pilot surface proximate each guide pin. A unison ring connects to the vanes and is rotatable substantially about a longitudinal axis for pivoting the vanes about their respective axes, the unison ring defining a radially inner surface. The radially inner surface of the unison ring makes sliding contact with the wear surface of each guide pin and/or the outer pilot surface as the unison ring rotates in one direction or the other substantially about the longitudinal axis. Each guide pin and/or the outer pilot surface restrain radial movement of the unison ring while allowing for rotational movement of the unison ring.

According to one embodiment of the turbocharger, the wear surface of each guide pin defines a circumferential radius of curvature (defined as the curvature in the circumferential direction) substantially equal to a circumferential radius of curvature of the radially inner surface of the unison ring. In an additional embodiment each guide pin is formed from a first material which is relatively harder and more resistant to high-temperature oxidation than a second material which forms the center housing. In this embodiment the unison ring may be formed from a material which is harder than the second material. In particular, the unison ring may be formed from the first material.

In a further embodiment each guide pin may be secured to the center housing by being press-fit into a respective aperture defined in the center housing. Each guide pin may extend into each aperture along a direction that is generally parallel to the longitudinal axis about which the unison ring rotates. Additionally, each guide pin may have a generally circular cross-section except for the wear surface. Further, there may be at least three of the guide pins circumferentially spaced about the longitudinal axis.

An alternate embodiment of a variable geometry turbocharger may comprise many of the above described components, but each guide pin may be fixedly mounted in other locations in the turbocharger, such as mounted in respective apertures in a nozzle ring. In some such embodiments the circumferential radius of curvature of the wear surface of each guide pin substantially matches the circumferential radius of curvature of the radially inner surface of the unison ring.

In turbochargers according to the present disclosure smooth rotation of the unison ring is thought to be facilitated by the provision of the guide pins mounted and configured as described herein. Other advantages and novel features of the present disclosure will become more apparent from the following detailed description of embodiments as taken in conjunction with the accompanying drawings.

BRIEF DESCRIPTION OF THE SEVERAL VIEWS OF THE DRAWING(S)

Having thus described embodiments in general terms, reference will now be made to the accompanying drawings, which are not necessarily drawn to scale, and wherein:

DETAILED DESCRIPTION OF THE DRAWINGS

Figure 1:
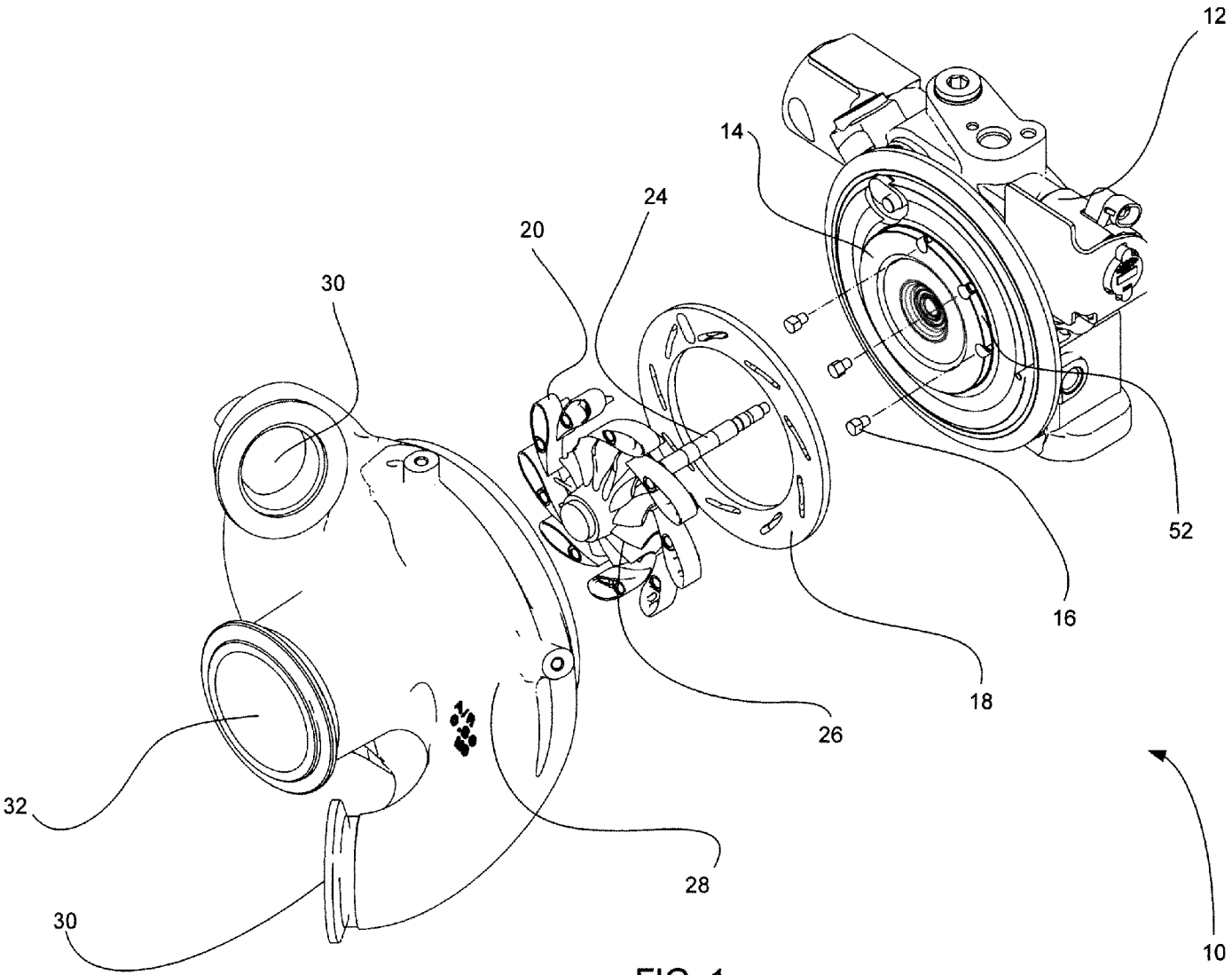
FIG. 1 illustrates an exploded perspective view of an embodiment of a multiple vane variable nozzle turbocharger looking from a turbine housing toward a compressor housing.

Apparatuses and methods for varying turbocharger vane configurations now will be described more fully hereinafter with reference to the accompanying drawings, in which some but not all embodiments are shown. Indeed, the present development may be embodied in many different forms and should not be construed as limited to the embodiments set forth herein; rather, these embodiments are provided so that this disclosure will satisfy applicable legal requirements. Like numbers refer to like elements throughout.

In variable nozzle turbochargers it is important that the individual vanes be configured and assembled within the turbine housing to move or pivot freely in response to a desired exhaust gas flow control actuation in order to ensure proper and reliable operation. Because these pivoting vanes may be subjected to a large number of high temperature cycles during the turbocharger's operational life, it is necessary that any such pivoting mechanism be one that is capable of repeatably functioning under such cycled temperature conditions without any temperature-related material or mechanical problem or failure.

A variable geometry or variable nozzle turbocharger generally comprises a center housing having a turbine housing attached at one end, and a compressor housing attached at an opposite end. A shaft is rotatably disposed within a bearing assembly contained within the center housing. A turbine wheel is attached to one shaft end and is carried within the turbine housing, and a compressor wheel or impeller is attached to an opposite shaft end and is carried within the compressor housing.

Some embodiments of variable nozzle turbochargers include vanes that pivot about bearing pins, each such bearing pin being mounted within a respective aperture in a turbine housing, nozzle wall, or nozzle ring. The vanes may be commonly actuated to pivot about the axes defined by the bearing pins. In particular, the vanes can be pivoted via rotation of a unison ring which engages each of the vanes such that they pivot or otherwise change orientation or position when the unison ring rotates. However, it has been found that use of a unison ring to pivot the vanes can be susceptible to certain operability issues.

For example, in some multiple vane variable nozzle turbochargers, the unison ring contacts and rotates about an outer pilot surface of a center housing of the turbocharger. Applicants have discovered that over time the pivoting of the unison ring may damage either the unison ring or the center housing. In particular, the unison ring may be nitrided such that is relatively harder than the center housing, which may be formed from cast iron. In such configurations, the rotation of the unison ring may "scar" the outer pilot surface of the center housing. Such damage can result in the unison ring binding or moving more slowly than desired, and turbocharger performance is thereby degraded.

In other known multiple vane variable nozzle turbochargers, the unison ring may be guided by a plurality of pins secured to a nozzle ring and about which the unison ring rotates. While such arrangements avoid the issue of contact between the center housing and the unison ring, the pins create very small contact areas at the tangential line of contact between the radially inner surface of the unison ring and the round outer surface of the pins. These very small contact areas can result in similar scarring problems due to loads on the unison ring being concentrated on the small contact areas.

FIG. 1 illustrates an exploded view of an embodiment of an improved variable geometry turbocharger assembly 10. The turbocharger 10 comprises a compressor housing 12, a center housing 14, guide pins 16, a unison ring 18, vanes 20, a shaft 24, a turbine wheel 26, and a turbine housing 28. The turbine housing 28 includes one or more inlets 30 for receiving an exhaust gas stream, and an outlet 32 for directing exhaust gas out of the turbocharger 10 and to the exhaust system of the engine.

Figure 2:
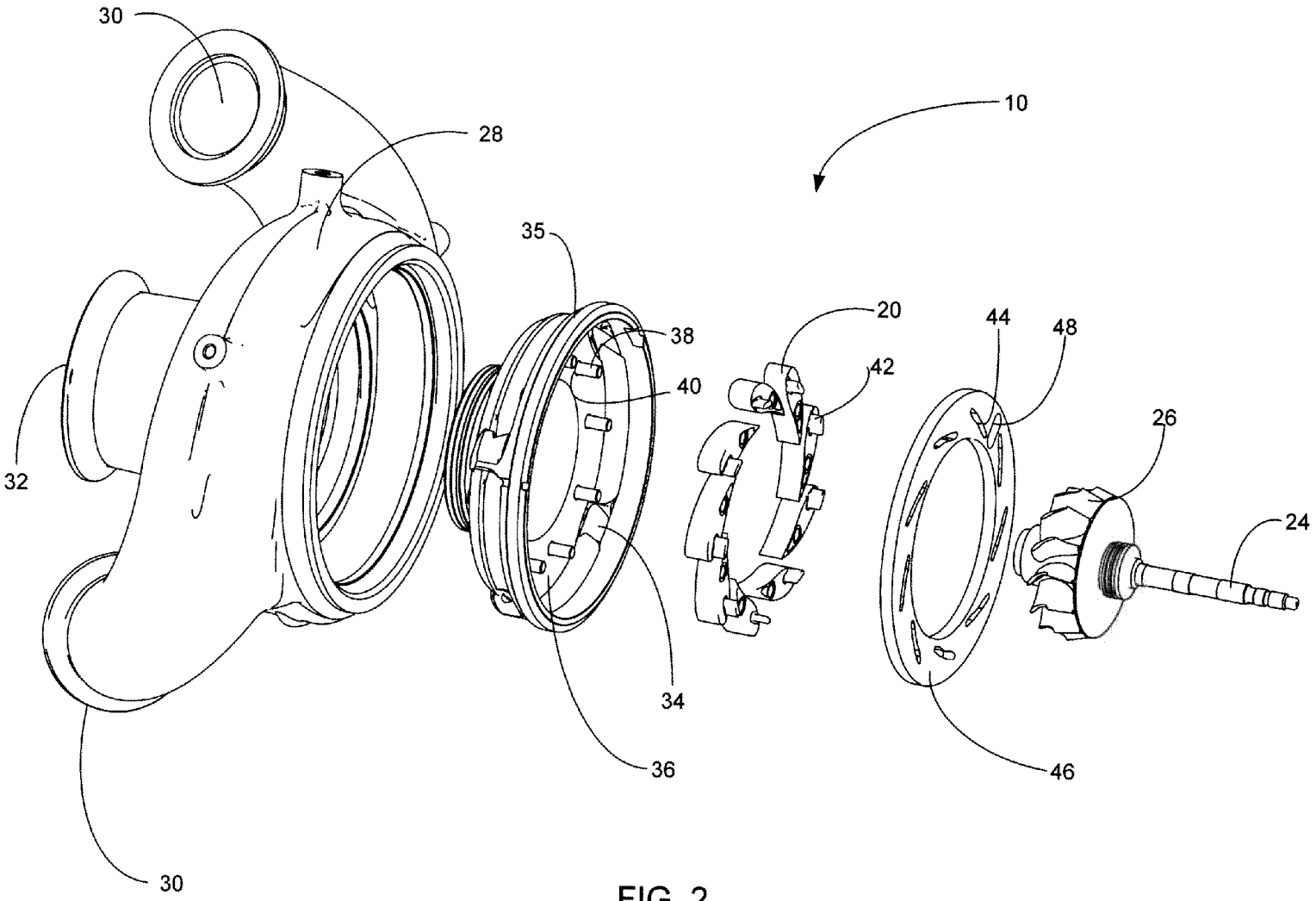
FIG. 2 illustrates an exploded perspective view of a portion of the turbocharger of FIG. 1 looking toward the inside of the turbine housing.

FIG. 2 illustrates an exploded partial view of the turbocharger 10 of FIG. 1. As may be seen from this perspective, exhaust gas, or other high energy gas supplying the turbocharger 10, enters the turbine housing 28 through the inlets 30. Thereafter, the exhaust gas flows through a plurality of circumferentially spaced openings 34 in a turbine housing insert 35 whereby the exhaust gas is supplied through a nozzle defined within the turbine housing insert for substantially radial entry into the turbine wheel 26, which is carried within the turbine housing 28. The exhaust gas is prevented from traveling in directions other than into the turbine wheel 26 and out the outlet 32 by a nozzle wall 36 defined by the turbine housing insert 35 and located adjacent the turbine wheel. Note that although the illustrated embodiment of the turbocharger 10 uses a turbine housing insert 35 to define a nozzle, alternate embodiments of turbochargers may lack a turbine housing insert and thus may have the nozzle defined by other components such as the turbine housing itself.

The nozzle defines a nozzle passageway through which exhaust gas travels to the turbine wheel 26. Multiple vanes 20 are disposed within the nozzle passageway. The vanes 20 are mounted to the nozzle wall 36 by bearing pins 38 that project perpendicularly outwardly from the nozzle wall when they are assembled together. The bearing pins 38 are engaged in respective apertures 40 in the nozzle wall 36, although the bearing pins may engage apertures in other portions of the turbocharger in other embodiments as described above. The vanes 20 include respective actuation tabs 42 that project from a side opposite the bearing pins 38 and that are engaged in respective slots 44 in a unison ring 46, which acts as a second nozzle wall.

An actuator assembly (not shown) is connected with the unison ring 46 through an actuator hole 48 and is configured to rotate the unison ring in one direction or the other as necessary to rotate the vanes 20 about axes defined by their respective bearing pins 38 and thereby pivot the vanes clockwise or counter-clockwise to respectively increase or decrease the flow area of the nozzle passageway. As the unison ring 46 is rotated, the vane tabs 42 are caused to move within their respective slots 44 from one slot end to an opposite slot end. Since the slots 44 are oriented with a radial directional component along the unison ring 46, the movement of the vane tabs 42 within the respective slots causes the vanes 20 to pivot as noted above. An example of a known variable nozzle turbocharger comprising such elements is disclosed in U.S. Pat. No. 6,419,464 issued Jul. 16, 2002 entitled VANE FOR VARIABLE NOZZLE TURBOCHARGER, having a common assignee with the present application, which is incorporated herein by reference.

Figure 3:
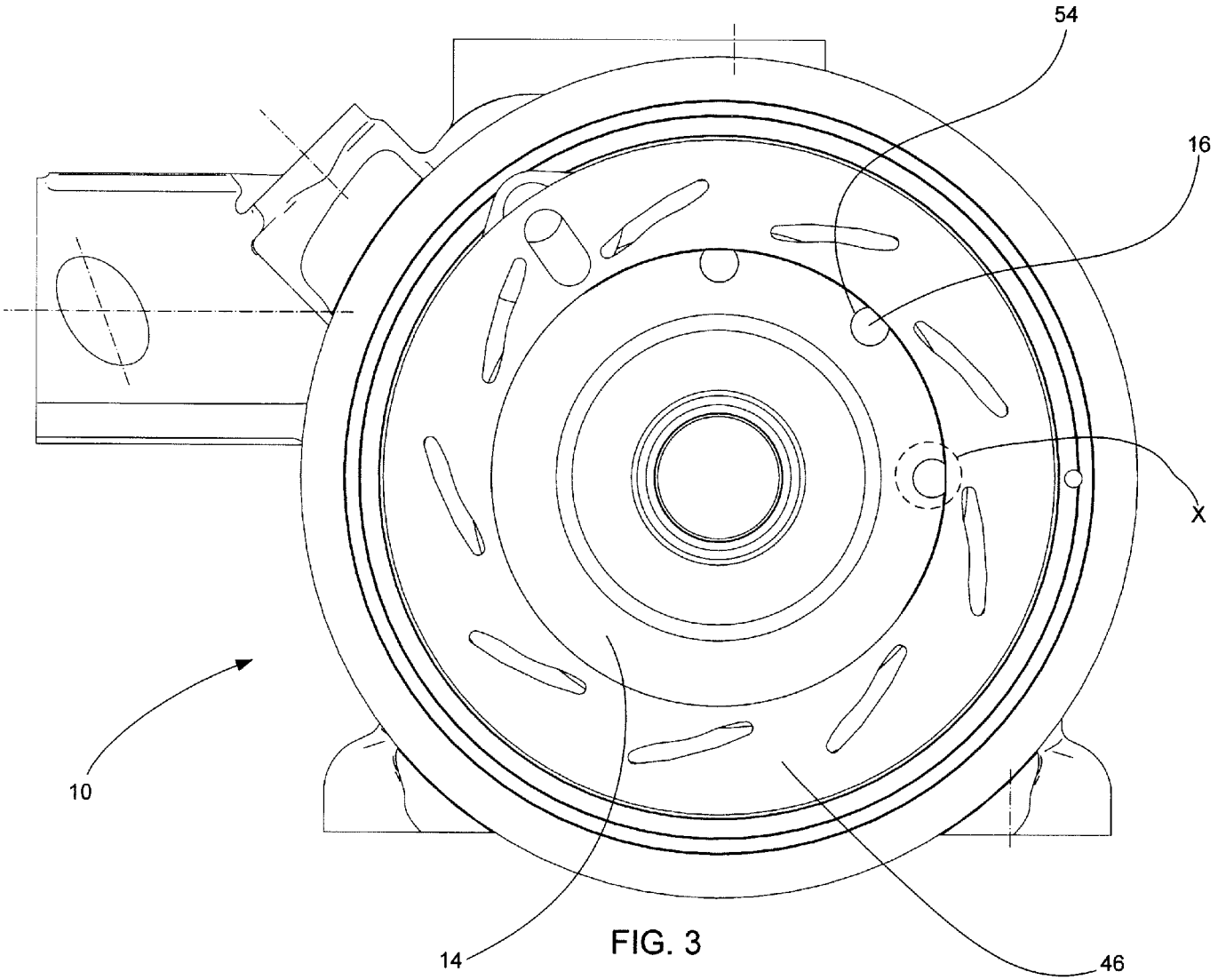
FIG. 3 illustrates a view of a portion of the turbocharger of FIG. 1 including and a center housing with a unison ring and guide pins.

As mentioned above, proper operation of the turbocharger 10 requires that the unison ring 46 be permitted to rotate freely with minimal resistance. Accordingly, embodiments of the turbocharger 10 include one or more guide pins 16 which, as illustrated in FIG. 3, may be secured to the center housing 14. In particular, the guide pins 16 may be secured to the center housing 14 adjacent the outer pilot surface 52 (see FIG. 1 and FIG. 4). In the illustrated embodiment the guide pins 16 are inserted into respective apertures 54 in directions which are substantially parallel to the longitudinal axis defined by the shaft 24 (see FIGS. 1 and 2) and substantially about which the unison ring 46 rotates.

Figure 4:
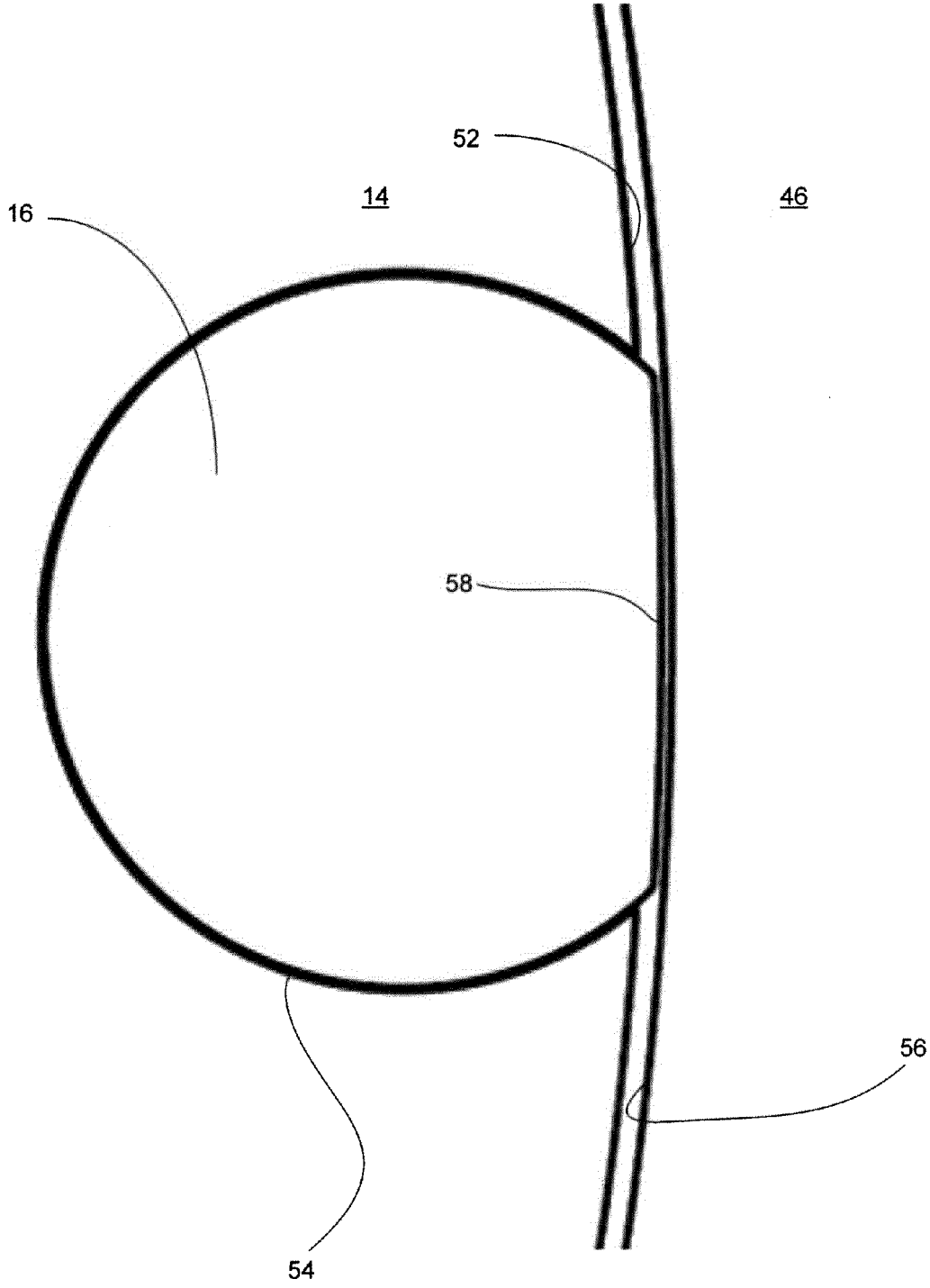
FIG. 4 illustrates an enlarged view of detail portion X of FIG. 3.

Thus, as illustrated in FIG. 4, which shows an enlarged view of detail portion X in FIG. 3, the radially inner surface 56 of the unison ring 46 may make sliding contact with the guide pins 16, which allow the unison ring to rotate, but restrain radial movement of the unison ring. Note that the illustrated embodiment includes a small clearance between the guide pins 16 and the unison ring 46. This clearance may be necessary to prevent the unison ring 46 from binding with the guide pins 16 or the outer pilot surface 52.

By using the guide pins 16, wear on the outer pilot surface 52 of the center housing 14 may be reduced because the guide pins can at least partially define the surface which the unison ring 46 rotates on. Returning to FIGS. 1 and 3, it is of note that the guide pins 16 are positioned around only a portion of the circumference of the center housing 14. In this embodiment when the unison ring 26 is rotated in a clockwise direction, the unison ring moves the vanes 20 such that they decrease the flow area of the nozzle passageway. As a result of the clearance between the radially inner surface 56 of the unison ring 46 and the outer pilot surface 52 of the center housing 14 (see FIG. 4), the unison ring may shift slightly with respect to the axis defined by the shaft 24 when the unison ring is rotated. As a further result of the actuator hole 48 being positioned at the upper left as viewed in FIG. 3, the unison ring 46 may tend to shift in such a manner so as to contact the center housing 14 along the outer pilot surface 52 at a position opposite of the guide pins 16 (i.e. the lower left of FIG. 3). This movement may also tend to push the unison ring 46 away from the guide pins 16 so that there is little if any contact therebetween. When the unison ring 46 is moved in the counterclockwise direction (as viewed from the perspective in FIG. 3) in order to increase the flow area of the nozzle passageway, the opposite occurs whereby the unison ring tends to make contact with the guide pins 16 which protect the center housing 14 from damage at this location.

Thus, the guide pins 16 can be positioned adjacent the outer pilot surface 52 at positions around the center housing 14 where scaring of the unison ring 46 or outer pilot surface is expected to otherwise occur. Further, any number of guide pins 16 can be used, and they can be spaced as needed to protect the areas of high wear. However, it has been determined that when the guide pins 16 comprise a generally circular cross-section along the portions of the guide pins that contact the unison ring 46, the contact areas between the guide pins and the unison ring take the form of very narrow tangential lines of contact. Small areas of contact such as these can result in increased wear of the guide pins 16 and/or the unison ring 46 due to load placed on the unison ring being concentrated on the narrow tangential lines of contact.

Accordingly, the guide pins 16 may be configured to promote smooth operation of the unison ring 46. In particular, the guide pins 16 may be formed from a material which is harder than that of the center housing 14. For instance, as stated above, the center housing 14 may be formed from cast iron, which may be relatively softer than the unison ring 46, such as when the unison ring 46 has been hardened (e.g., by being subjected to nitridization). Therefore, the guide pins 16 may also be formed from a material which is harder than the center housing 14, such as the same nitrided material used to form the unison ring 46. By forming the guide pins 16 and the unison ring 46 from materials of similar hardness, neither material may be relatively more prone to wear. Further, the guide pins 16 and/or the unison ring 46 may also be made more high-temperature oxidization resistant, such as through nitridization as described above.

An additional feature which may resist wear in order to promote smooth operation of the unison ring 46 is that the guide pins 16 may each define a wear surface 58 that extends to a larger radius from the longitudinal axis defined by the shaft 24 (see FIGS. 1 and 2) than an outer radius defined by the outer pilot surface 52 of the center housing 14 proximate the guide pins. By extending the guide pins 16 past the outer pilot surface 52 of the center housing 14 proximate the guide pins, the radially inner surface 56 of the unison ring 46 may be separated from the outer pilot surface by a clearance, which is greater than the above mentioned small clearance between the guide pins and the radially inner surface of the unison ring, such that there is no contact therebetween in the vicinity of the guide pins 16. Accordingly, particularly in embodiments where the guide pins 16 are formed from a material which is relatively harder than the center housing 14, wear on the outer pilot surface 52 can be reduced, as the unison ring 46 rotates on the guide pins.

However, even when the guide pins 16 and unison ring 46 are formed from relatively hard materials and/or the guide pins extend to a radius which is greater than the outer radius of the outer pilot surface 52 proximate the guide pins, a small area of contact between the guide pins and the unison ring may still exist. In order to address this issue, the guide pins 16 can be formed to have wear surfaces 58 that define a circumferential radius of curvature substantially equal to the circumferential radius of curvature of the radially inner surface 56 of the unison ring 46.

One method of matching the radius of curvature of the wear surface 58 of the guide pins 16 with the radius of curvature of the radially inner surface 56 of the unison ring 46 comprises inserting the guide pins, which may be cylindrical such that they define a round cross-section, into the apertures 54 in the center housing 14 which are near the outer pilot surface 52. The apertures 54 may be cast as part of the center housing 14, or may be added later, such as through drilling holes. The insertion may be accomplished through press-fitting the guide pins 16 into the apertures 54 such that they are securely fastened to the center housing 14. In particular, the apertures 54 may each extend into the center housing 14 along a direction that is generally parallel to the longitudinal axis defined by the shaft 24 (see FIGS. 1 and 2) and substantially about which the unison ring 46 rotates. Thus, when the guide pins 16 are inserted into the apertures 54, the guide pins' axes may also be substantially parallel to the longitudinal axis about which the unison ring 46 rotates.

After inserting the guide pins 16 into the apertures 54, the center housing 14 and the guide pins may both be machined, such as by CNC milling or other suitable technique, so that the wear surfaces 58 and the outer pilot surface 52 each define substantially the same circumferential radius of curvature. This radius of curvature may be chosen such that it substantially matches a circumferential radius of curvature of the radially inner surface 56 of the unison ring 46. However, as mentioned above, contact between the unison ring 46 and the outer pilot surface 52 may be undesirable near the guide pins 16. Accordingly, the center housing 14 may be further machined along the outer pilot surface 52 proximate the guide pins 16 in order to increase the clearance between the outer pilot surface and the radially inner surface 56 of the unison ring 46.

By substantially matching the radius of curvature of the wear surfaces 58 of the guide pins 16 with the radius of curvature of the radially inner surface 56 of the unison ring 46, the total area of contact is greatly increased. Thus, loads placed on the unison ring 46 when it is rotated to change the configuration of the vanes 20 (see FIGS. 1 and 2) are dispersed over the enlarged wear surfaces 58 of the guide pins 16. Further, contact between the unison ring 46 and the outer pilot surface 52 may be avoided due to the relatively larger clearance therebetween. Accordingly, scarring may be reduced such that the unison ring 46 may rotate more smoothly.

However, the guide pins 16 are not limited to use with the unison ring 46 which rotates about the outer pilot surface 52 of the center housing 14. Various other embodiments of turbochargers may utilize unison rings which rotate on guide pins fixedly mounted in the turbocharger. For instance, turbochargers may have a variable-vane assembly which comprises a unison ring that rotates on one or more guide pins fixedly mounted to a nozzle ring. In such turbochargers, the guide pins may be modified according to the present disclosure so that they have wear surfaces which have a radius of curvature which is substantially equal to a radius of curvature of the radially inner surface of the unison ring. Accordingly similar benefits resulting from larger contact patches as opposed to tangential line contact may be achieved as discussed above. Such embodiments may also include many of the other above-described features including orientation of the guide pins such that they are fixedly mounted in a plurality of apertures whereby the guide pins extend generally parallel to the longitudinal axis about which the unison ring rotates. Further, the guide pins can define a generally circular cross-section except for the wear surfaces. Additionally, three or more of the guide pins may be circumferentially spaced about the longitudinal axis about which the unison ring rotates in order to radially position the unison ring.

Many modifications and other embodiments will come to mind to one skilled in the art to which these embodiments pertain having the benefit of the teachings presented in the foregoing descriptions and the associated drawings. Therefore, it is to be understood that modifications and other embodiments are intended to be included within the scope of the appended claims. Although specific terms are employed herein, they are used in a generic and descriptive sense only and not for purposes of limitation.

That which is claimed:

1. A variable geometry turbocharger assembly, comprising:

a turbine housing defining an inlet for exhaust gas and an outlet;

a turbine wheel within the turbine housing and attached to a shaft;

a nozzle defining a nozzle passage for exhaust flow to the turbine wheel;

a plurality of vanes disposed within the nozzle passage, each vane mounted on a bearing pin and each vane configured to pivot about an axis defined by the respective bearing pin;

a center housing connected to the turbine housing and comprising an outer pilot surface defining an outer radius;

at least one guide pin secured to the center housing adjacent to the outer pilot surface, each guide pin defining a wear surface that extends to a radius which is larger than the outer radius of the outer pilot surface proximate each guide pin; and a unison ring connected to the vanes and rotatable substantially about a longitudinal axis defined by the shaft for pivoting the vanes about the respective axes, the unison ring defining a radially inner surface;

wherein the radially inner surface of the unison ring makes sliding contact with the wear surface of each guide pin and/or the outer pilot surface of the center housing as the unison ring rotates substantially about the longitudinal axis, each guide pin and/or the outer pilot surface restraining radial movement of the unison ring while allowing for rotational movement of the unison ring.

2. The turbocharger assembly of claim 1, wherein the wear surface of each guide pin defines a circumferential radius of curvature substantially equal to a circumferential radius of curvature of the radially inner surface of the unison ring.

3. The turbocharger assembly of claim 1, wherein each guide pin is formed from a first material which is relatively harder than a second material which forms the center housing.

4. The turbocharger assembly of claim 3, wherein the unison ring is formed from a material which is harder than the second material.

5. The turbocharger assembly of claim 4, wherein the unison ring is foamed from the first material.

6. The turbocharger assembly of claim 3, wherein the first material is relatively more high-temperature oxidation resistant than the second material.

7. The turbocharger assembly of claim 1, wherein each guide pin is secured to the center housing by being press-fit into an aperture defined in the center housing.

8. The turbocharger assembly of claim 7, wherein each guide pin extends into each aperture along a direction that is generally parallel to the longitudinal axis substantially about which the unison ring rotates.

9. The turbocharger assembly of claim 1, wherein each guide pin has a generally circular cross-section except for the wear surface.

10. The turbocharger assembly of claim 1, wherein there are at least three of the guide pins, which are circumferentially spaced about the longitudinal axis.

11. The turbocharger assembly of claim 1, further comprising a turbine housing insert coupled to the turbine housing, wherein the nozzle is defined at least in part by the turbine housing insert.

12. A variable geometry turbocharger assembly, comprising:

a turbine housing defining an inlet for exhaust gas and an outlet;

a turbine wheel within the turbine housing and attached to a shaft;

a nozzle defining a nozzle passage for exhaust flow to the turbine wheel;

a plurality of vanes disposed within the nozzle passage, each vane mounted on a bearing pin and each vane configured to pivot about an axis defined by the respective bearing pin;

at least one guide pin fixedly mounted in the turbocharger assembly, each guide pin defining a wear surface with a circumferential radius of curvature; and a unison ring connected to the vanes and rotatable substantially about a longitudinal axis defined by the shaft for pivoting the vanes about the respective axes, the unison ring defining a radially inner surface with a circumferential radius of curvature substantially equal to the circumferential radius of curvature of each wear surface;

wherein the radially inner surface of the unison ring makes sliding contact with each wear surface of each guide pin as the unison ring rotates substantially about the longitudinal axis, each guide pin restraining radial movement of the unison ring while allowing for rotational movement of the unison ring.

13. The turbocharger assembly of claim 12, wherein each guide pin is secured to the turbocharger assembly by being press-fit into an aperture defined in the turbine housing.

14. The turbocharger assembly of claim 12, wherein each guide pin has a generally circular cross-section except for the wear surface.

15. The turbocharger assembly of claim 12, wherein there are at least three of the guide pins, which are circumferentially spaced about the longitudinal axis.

16. The turbocharger assembly of claim 12, further comprising a turbine housing insert coupled to the turbine housing, wherein the nozzle is defined within the turbine housing insert.

* * * * *